United States Patent [19]

Boidron

[11] Patent Number: 4,787,184

[45] Date of Patent: Nov. 29, 1988

[54] DOOR AND WINDOW FRAME

[76] Inventor: Guy A. D. Boidron, Le Pave Neuf, 37500 Chinon, France

[21] Appl. No.: 30,573

[22] Filed: Mar. 27, 1987

[30] Foreign Application Priority Data

Apr. 4, 1986 [FR] France ..... 86 04848

[51] Int. Cl.[4] ..... E06B 1/04

[52] U.S. Cl. ..... 52/217

[58] Field of Search ..... 52/217

[56] References Cited

U.S. PATENT DOCUMENTS 4,407,100 10/1983 Huelsekopf .

FOREIGN PATENT DOCUMENTS 0537021 5/1980 Australia .
2226538 11/1974 France .
2456823 12/1980 France .
0517887 2/1972 Switzerland .
1216370 12/1970 United Kingdom .

*Primary Examiner*—Carl D. Friedman
*Attorney, Agent, or Firm*—Sandler & Greenblum

[57] ABSTRACT

A door and window frame formed from two connected L-shaped members. One L-shaped member has a first arm and inner and outer second arms; both second arms are approximately perpendicular to and intersect the first arm. The second L-shaped member has single intersecting and perpendicular first and second arms. One of the second arms of the first L-shaped member, and the second arm of the second L-shaped member, are provided with teeth for holding the members in position to form the frame. One or both of the L-shaped members is provided with an internal groove which can support a deformable strip thicker than the depth of the groove.

3 Claims, 1 Drawing Sheet

DOOR AND WINDOW FRAME

BACKGROUND OF THE INVENTION

1. Field of the Invention

This invention relates to fixed frames for doors and windows, particularly, but not exclusively, for use with recreational vehicles and trailers.

2. Description of Background and Relevant Materials

In the present state of the art, frames having fixed portions for fitting into wall or door openings are provided with peripheral flanges. These peripheral flanges are attached to the corresponding surface of the door or wall by such means as screws or rivets. Frames of this type require the presence of uprights or girders buried in the wall.

There have recently appeared on the market walls comprising panels of insulating rigid foam with surface coverings of thin metallic film. These panels do not lend themselves to riveting or screwing, and therefore pose problems with respect to providing support for door and window frames.

The present invention overcomes these problems by providing a frame which can be mounted in the opening of a wall or door without requiring screws, or other attachment means.

The frame of the present invention comprises two shaped members, each configured to form a general "L" shaped crosssection. Both members are provided with means for fitting them together to form a shaped member having a "U" shaped cross-section.

One of these members, preferably the principal, or first member, further includes one or more grooves situated in the exterior surface of one of the arms of the member for the purpose of mounting any manner of elements, such as windows, or the like. This member is further preferably provided with a secondary arm, parallel to and beneath the arm in which the one or more grooves are situated. This secondary arm is provided with longitudinally extending teeth adapted to cooperate with similar teeth provided in one of the arms of the other shaped member.

SUMMARY OF THE INVENTION

The invention is directed to a frame for doors and windows. The frame comprises a first L-shaped member having a first arm and approximately parallel inner and outer second arms. Both second arms are approximately perpendicular to and intersect with the first arm. The frame further comprises a second L-shaped member comprising intersecting and approximately pependicular first and second arms. One of the second arms of the first L-shaped member, and the second arm of the second L-shaped member, comprise means for cooperating to connect the first and second L-shaped members; at least one of the first arms comprises an internal groove for supporting a deformable strip having a thickness greater than the depth of the groove.

In a preferred embodiment, the cooperating means comprise teeth opposedly mounted on the second arms.

In another preferred embodiment, the first L-shaped arm is provided with a shoulder extending along the inner second arm from the angle formed by the intersection of the first arm and the inner second arm.

The invention is described with reference to the following drawings, which are provided by way of example, not limitation.

DESCRIPTION OF PREFERRED EMBODIMENTS

Figure 1:
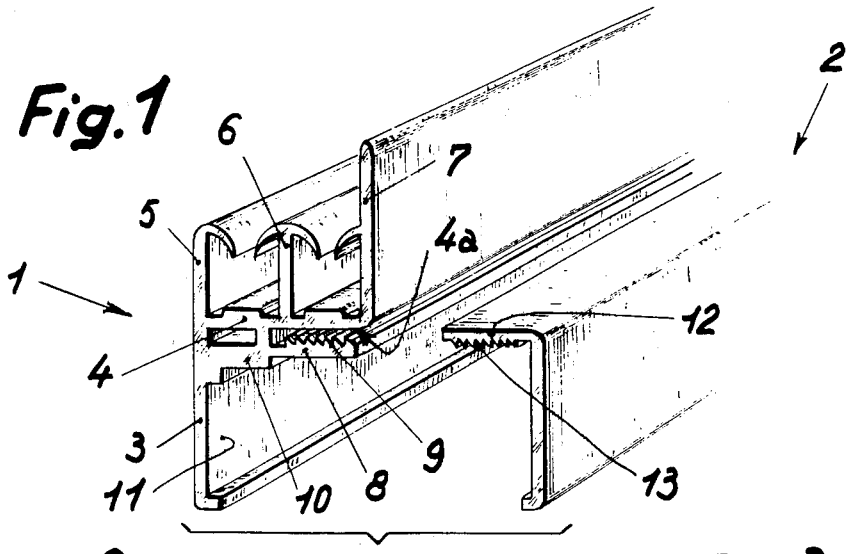
FIG. 1 is a perspective view of the two shaped members of the invention.

As shown in FIG. 1, both principal shaped member 1 and secondary shaped member 2 are configured to form, in cross section, the shape of a corner, or of an "L". Shaped member 1 is provided with arms 3 and 4. Arm 4 further comprises ribs 5, 6, and 7 mounted on its exterior surface to provide conventional reception grooves for windows (not shown). These grooves can also be provided by means of a conventional shaped member (not shown) mounted on arm 4, or attached thereto by any conventional means.

Shaped member 1 further comprises auxiliary arm 8 parallel to and distanced from interior surface **4*a* of arm 4. Longitudinal teeth 9, projecting toward interior surface 4*a*, are mounted on auxiliary arm 8. These teeth, which are preferably identical, are configured to provide, in cross section, the shape of a rectangular triangle whose hypotenuse is directed toward the end of auxiliary arm 8**.

Preferably, auxiliary arm 8 is made of a deformable elastic material. Shaped member 1 is preferably made by means of extrusion, and is preferably formed of a rigid, plastic, and elastically deformable material.

The function of shoulder 10, interposed between auxiliary arm 8 and arm 3, and of groove 11, situated in arm 3, are discussed in more detail hereinafter.

The lower surface of arm 12 of secondary shaped member 2 is provided with teeth 13. Teeth 13 are preferably identical to teeth 9 of principal shaped member 1.

Shaped members 1 and 2 are sectioned, with each of the sections forming a portion of the frame. The door or window frame of the invention is formed by connecting shaped members 1 and 2.

Figure 2:
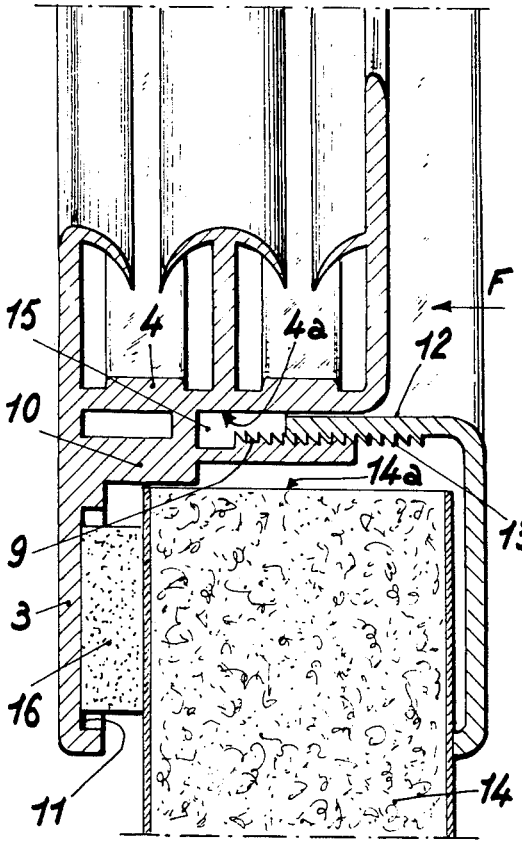
FIG. 2 is a partial cross-sectional view of the frame, formed by the shaped members of FIG. 1, mounted on the wall of a living area.
Figure 3:
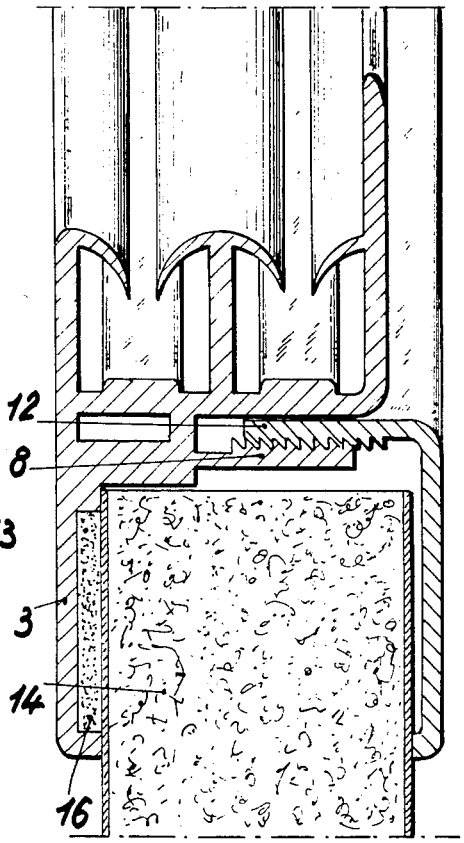
FIG. 3 is a partial cross-sectional view analogous to that of FIG. 2, showing the frame of the invention mounted on a wall of greater thickness.

FIGS. 2 and 3 show the frame of the invention mounted on panel 14, having lower edge **14*a***.

Shoulder 10 allows the frame to be centered in the opening, and further maintains auxiliary arm 8 at a distance from edge **14*a* of panel 14**.

In forming the frame of the invention, the end of arm 12 of secondary shaped member 2 is engaged in space 15 between auxiliary arms 8 and 4. The two members are assembled by exerting pressure in the direction of arrow F. As shown in FIG. 3., this pressure flexes arm 8 and impels teeth 13 to penetrate between teeth 9.

As a significant aspect of a preferred embodiment of the invention, strip 16, preferably made of an elastically deformable material, such as plastic foam, is interposed between the lateral surface of panel 14 and the interior surface of arm 3 during the assembly of the frame. In its non-deformed state, strip 16 is of thickness greater than the depth of groove 11.

As shown in FIG. 3, strip 16, after assembly of the two members, is compressed into groove 11. Strip 16 thereby serves a double function. It provides a seal between the frame and the panel; also, by means of the pressure which it exerts against the teeth, it contributes to the latching of the two assembled members.

A second strip, analogous to strip 16, can be inserted between the other lateral surface of the panel and the interior surface of secondary shaped member 2.

It is further noted that the frame of the invention may be mounted on panels of varying thickness. In effect, the portion of the frame formed by shaped member 2 serves as a joint cover. The same shaped member can be employed for panels of varying thickness without disturbing the aesthetic appearance of the assembly.

It is further understood that although the invention has been specifically described with reference to particular means and embodiments, the foregoing description is that of preferred embodiments of the invention, and the invention is not limited to the particulars disclosed, but extends to all equivalents, and various changes and modifications may be made in the invention without departing from the spirit and scope thereof.

What is claimed is:

1. A frame for doors and windows comprising:

(a) a first L-shaped member comprising:

(i) a first arm;

(ii) approximately parallel inner and outer second arms, both approximately perpendicular to said first arm, and said outer second arm intersecting with said first arm; and (iii) a shoulder interposed between said inner second arm and said first arm, said shoulder being adapted to space said inner second arm from an edge of said doors and windows;

(b) a second L-shaped member comprising intersecting and approximately perpendicular first and second arms; and (c) a compressible strip; wherein one of said second arms of said first L-shaped member, and said second arm of said second L-shaped member, comprise means for cooperating to connect said first and second L-shaped members, and wherein at least one of said first arms comprises an internal groove for supporting said compressible strip, said compressible strip being adapted to be supported in said internal groove, and being of a thickness greater than the depth of said internal groove.

2. The frame as defined by claim 1 wherein said cooperating means comprise teeth opposedly mounted on said second arms.

3. The frame as defined by claim 1 wherein said inner second arm comprises a deformable elastic material.

* * * * *